US006655662B2

(12) United States Patent
Kemppainen

(10) Patent No.: US 6,655,662 B2
(45) Date of Patent: Dec. 2, 2003

(54) METHOD FOR CONTROLLING CRANE BRAKE OPERATION

(75) Inventor: Matti Kemppainen, Hyvinkää (FI)

(73) Assignee: KCI Konecranes Plc, Hyvinkaa (FI)

( * ) Notice: Subject to any disclaimer, the term of this patent is extended or adjusted under 35 U.S.C. 154(b) by 0 days.

(21) Appl. No.: 09/954,079

(22) Filed: Sep. 18, 2001

(65) Prior Publication Data

US 2002/0033481 A1 Mar. 21, 2002

(30) Foreign Application Priority Data

Sep. 21, 2000 (FI) ..... 20002084

(51) Int. Cl.[7] ..... B66D 1/58
(52) U.S. Cl. ..... 254/275; 212/270; 212/278
(58) Field of Search ..... 254/275; 212/270, 212/278

(56) References Cited

U.S. PATENT DOCUMENTS

| | | | | | |
|---|---|---|---|---|---|
| 3,693,939 | A | * | 9/1972 | Buckson | 254/172 |
| 4,681,191 | A | * | 7/1987 | Ikejima | 187/119 |
| 4,733,148 | A | | 3/1988 | Rodi | |
| 5,120,023 | A | * | 6/1992 | Kawabata | 254/275 |
| 5,343,134 | A | | 8/1994 | Wendt et al. | |
| 5,734,135 | A | * | 3/1998 | Hakala et al. | 187/292 |
| 5,818,185 | A | * | 10/1998 | Freitag et al. | 318/432 |
| 6,029,951 | A | * | 2/2000 | Guggari | 254/269 |
| 6,051,942 | A | * | 4/2000 | French | 318/254 |

FOREIGN PATENT DOCUMENTS

| | | | |
|---|---|---|---|
| DE | 296 22 878 | * | 9/1997 |
| FR | 2675790 | | 10/1992 |
| JP | 2084088 | | 3/1990 |
| JP | 4265681 | | 9/1992 |

* cited by examiner

*Primary Examiner*—Thomas J. Brahan
(74) *Attorney, Agent, or Firm*—Birch, Stewart, Kolasch & Birch, LLP

(57) ABSTRACT

The invention relates to a method for controlling the operation of a crane brake, the crane comprising an electric motor (2) controlled by means of a frequency converter (10) for hoisting and lowering movements of the crane; an electromechanical brake (9) having an impact on said movements, the brake being opened when the motor is started for a hoisting or lowering operation; a load sensor (8) weighing a load (7) to be handled; and an overload protection connected to the sensor, the frequency converter (10) being used for calculating the torque of the motor (2), which information is compared with the load information, or weight, obtained from the load sensor (8).

3 Claims, 1 Drawing Sheet

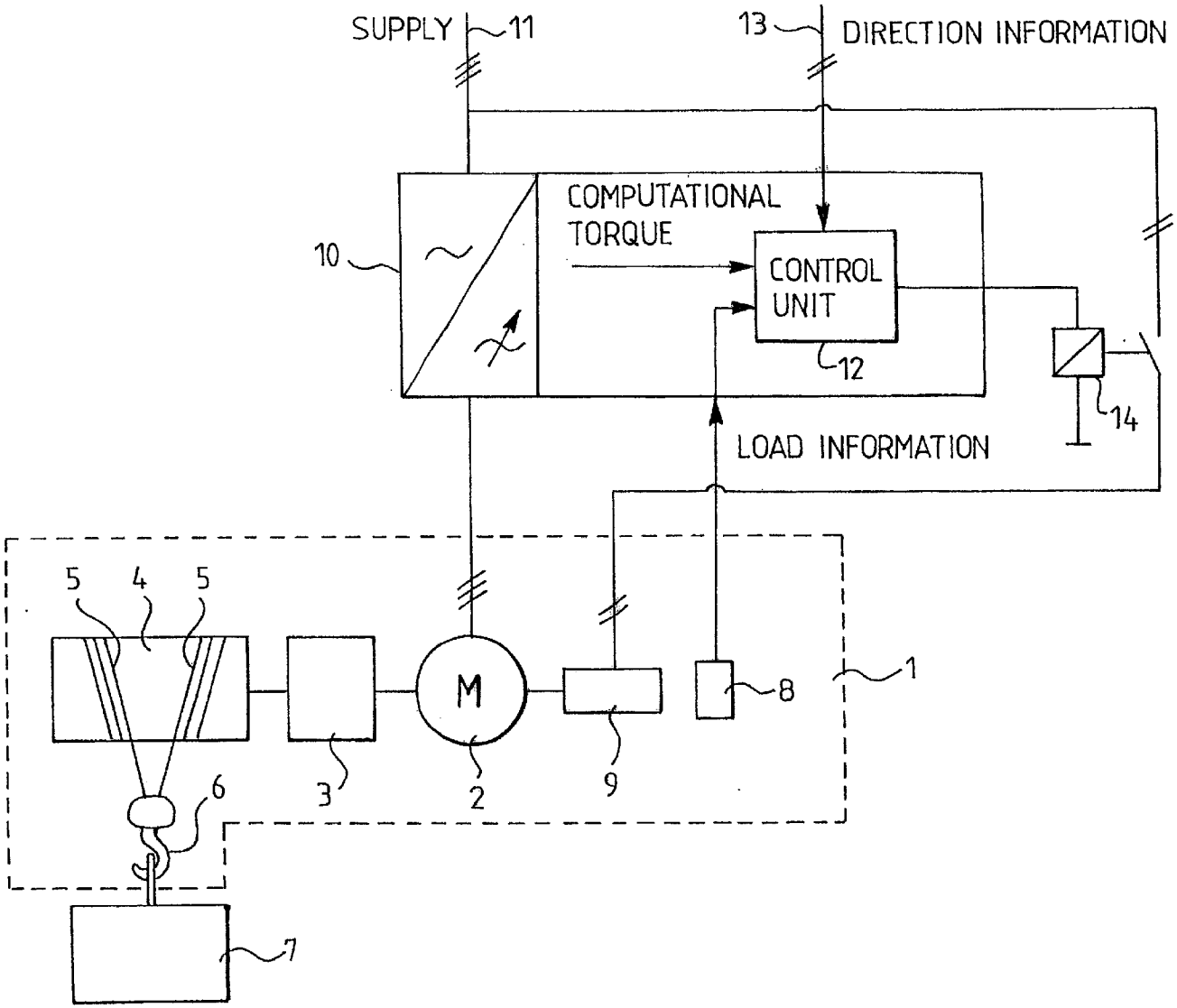
DIRECTION INFORMATION
13
SUPPLY
11
COMPUTATIONAL TORQUE
CONTROL UNIT
12
14
10
LOAD INFORMATION
1
8
9
M
2
3
5
4
5
6
7

METHOD FOR CONTROLLING CRANE BRAKE OPERATION

BACKGROUND OF THE INVENTION

The invention relates to a method for controlling the operation of a crane brake, the crane comprising an electric motor controlled by means of a frequency converter for hoisting and lowering movements of the crane; an electromechanical brake having an impact on said movements, the brake being opened when the motor is started for a hoisting or lowering operation; a load sensor weighing the load to be handled; and an overload protection connected to the sensor.

Electromechanical brakes are currently delivered either with no controls or provided with a micro switch arranged to measure the movement of the brake anchor plate. When the brake is in operation this movement is extremely small, typically 0.2–0.4 mm. The operating range of the switch is therefore very small and its mounting and tuning is difficult. A control or monitoring system is provided with a measuring circuit to ensure that when a load hoisting or lowering movement begins, the brake opens, i.e. the micro switch is closed. If the switch does not close within a predetermined time, the operation of the crane is stopped.

Systems delivered without any monitoring arrangements are problematic if the brake control system malfunctions or if the brake for some reason lags and does not open properly, in which case the brake heats up in only a few seconds to the extent that the friction properties of the friction material collapse and the brake is unable to hold the load.

Publications JP 2-084088 and FR 2 675 790 disclose brake control methods based on the above micro switch solutions to indicate brake position. Such unreliable solutions have been used in shoe brakes already for decades.

Publication JP 4-265681 teaches a method for detecting a brake malfunction, in which method motor current is gradually increased and measured with a speed sensor to indicate when the motor starts to rotate. The differences in currents between brakes with and without voltage are then compared. If the difference between the currents is too small, the brake is detected to be faulty.

U.S. Pat. No. 4,733,148 discloses a method in which the motor is driven at a nominal torque, and a speed feedback sensor reading will show whether the motor is running. This method cannot be applied as such to cranes. If the hoisting member is provided with a nominal load and the load is being brought downward at a nominal torque against the brake, the brake is in fact required to slip. U.S. Pat. No. 5,343,134 teaches a similar system in which the brake is monitored by checking the rotating speed of the motor. Although the system works for cranes, it also requires the speed of rotation of the motor to be known.

SUMMARY OF THE INVENTION

It is therefore an object of the invention to provide a method that allows the above problems to be solved. This is achieved with a method of the invention which is primarily characterized in that a frequency converter is used for calculating the torque of a motor, which information is compared with load information, or weight, obtained from a load sensor.

The invention is based on simply comparing the load weighing information with the motor torque information whenever the crane is operated. If the torque does not correspond to the information provided by the load sensor, there are additional losses in the system, either in the brake or some other mechanical structure. The crane can thus be halted before the brake warms up excessively.

The comparison according to the invention must be made taking the drive or hoisting direction into account: when the load is taken upward, the torque is scaled such that a nominal torque (100% torque) is required to hoist a nominal load (100%), whereby mutually corresponding load information and torque information are obtained within the entire load range. When the load is being lowered, the motor functions as a generator, the torque with nominal load (100%) being (apparatus efficiency)$^2$×100% torque (of a minus sign), which is −80 . . . −90%, depending on the efficiency.

If the brake drags, or if there is some other mechanical friction, the torque needed by the motor increases when the load is being hoisted and, correspondingly, the torque on the generator side decreases when the load is being lowered.

The control unit is provided with settable limits in which the torque information must be proportional to the load information, and with necessary filtering elements for filtering the torque needed for accelerating flier masses, although the torque can also be removed computationally on the basis of known acceleration and deceleration times and flier masses of the machinery.

The control can be implemented for example as follows:

1. Hoisting or lowering is initiated at a low speed and the brake is opened.
2. The load information to be obtained from the load sensor is compared with the torque information of the frequency converter, taking the driving direction into account.
3. If the information correspond to each other, a frequency converter ramp is released and a higher speed drive is allowed. If during the drive it is detected that the information differ from one another, the operation is halted.

This control can be programmed into the frequency converter or another programmable device. The most advantageous solution is naturally to program the function into the frequency converter itself because then the control can be implemented without any additional equipment.

A significant advantage of the invention is that systems already existing in the crane can be used for making reliable conclusions about the performance of the brake and another mechanical system, whereby additional sensors, which are expensive and difficult to provide, can be avoided. In addition, increased crane reliability is obtained compared with solutions based on micro switches because the system also detects other than brake faults in the hoisting apparatus (such as bearing damages, rope jamming, etc.)

LIST OF DRAWINGS

In the following, the invention will be described with reference to an example of a preferred embodiment and the accompanying drawing, which is a flow diagram of the method of the invention.

DETAILED DESCRIPTION OF THE INVENTION

With reference to the FIGURE, a crane hoisting apparatus denoted with reference numeral 1 comprises an electric motor 2 serving as an operating power source, the motor operating a lifting drum 4 through gearing 3, the drum being provided with lifting ropes 5 spooled on the drum, and the ends of the ropes being in turn provided with a lifting hook 6 for seizing a load 7. The hoisting apparatus 1 further comprises a load sensor 8 measuring the weight of the load 7 and an electromechanical brake 9 for braking the motor 2 and, thereby, the lifting drum 4.

The motor 2, and thereby the hoisting and lowering movements of the crane, are controlled by means of a frequency converter 10 to which the crane operator issues commands on a direction information line 13.

For controlling the braking operation, there is provided a control unit 12 which is placed in this case into the frequency converter 10 itself. The control unit 12 receives hoisting direction information over the line 13. Reference numeral 11 denotes a supply voltage line of the hoisting machinery.

Between the control unit 12 and the brake 9 there is connected a brake controller 14 which either keeps the brake 9 entirely open or closed, depending on the information received from the control unit 12.

When the crane is in operation, i.e. when the motor 2 is running and the load 7 moves either upward or downward, the frequency converter 10 calculates the torque of the motor 2 and transmits the information to the control unit 12. During the crane operation, the unit 12 continuously compares this computational torque information with the weighing information produced by the load sensor 8. If the load information and the torque information do not correspond to each other within the set tolerances (with the above described hoisting direction taken into account), the brake 9 is applied to stop the motor 2 which remains stopped for as long as there is the difference between said information, i.e. a disturbance or malfunction in the brakes.

The above specification is only meant to illustrate the basic idea of the invention. A person skilled in the art may, however, implement its details in various ways within the scope of the accompanying claims.

What is claimed is:

1. A method for controlling the operation of a crane brake, the crane comprising an electric motor controlled by means of a frequency converter for hoisting and lowering movements of the crane; an electromechanical brake having an impact on said movements, the brake being opened when the motor is started for a hoisting or lowering operation; a load sensor weighing a load to be handled; and an overload protection connected to the sensor, wherein the frequency converter is used for calculating the torque of the motor, which information is compared with the load information, or weight, obtained from the load sensor.

2. A method according to claim 1, wherein, when the load is being hoisted, the hoisting movement is stopped if the load information and the torque information do not substantially correspond to each other, and when the load is being lowered, the lowering movement is stopped, if the torque information is substantially different from a minus-sign product (machinery efficiency)$^2$×load information.

3. A method according to claim 1 or 2, wherein the control operations are programmed into the frequency converter.

* * * * *